US006083675A

United States Patent [19]

Bell et al.

[11] Patent Number: 6,083,675

[45] Date of Patent: Jul. 4, 2000

[54] COLOR PHOTOGRAPHIC RECORDING MATERIAL CONTAINING A NON-DIFFUSING, 2-EQUIVALENT COUPLER WHICH, ON COUPLING, FORMS A DYE REMOVABLE BY RINSING

[75] Inventors: Peter Bell, Köln; Hans-Ulrich Borst, Elsdorf; Ralf Büscher, Lohmar; Jörg Siegel, Köln, all of Germany

[73] Assignee: Agfa Gevaert N.V., Belgium

[21] Appl. No.: 09/044,782

[22] Filed: Mar. 19, 1998

[30] Foreign Application Priority Data

Mar. 26, 1997 [DE] Germany ..... 197 12 692

[51] Int. Cl.[7] ..... G03C 1/46

[52] U.S. Cl. ..... 430/505

[58] Field of Search ..... 430/506, 502, 430/503, 505, 543, 552, 553, 554, 555, 556, 557, 558, 359

[56] References Cited

U.S. PATENT DOCUMENTS 4,310,618 1/1982 Fernandez ..... 430/381
5,830,628 11/1998 Borst et al. ..... 430/506

FOREIGN PATENT DOCUMENTS 0 109 831 3/1981 European Pat. Off. .
19508115 9/1996 Germany .

*Primary Examiner*—Geraldine Letscher
*Attorney, Agent, or Firm*—Connolly Bove Lodge & Hutz LLP

[57] ABSTRACT

A multi-layer color photographic recording material having at least one photosensitive silver halide emulsion layer containing a color coupler contains in at least one photosensitive silver halide emulsion layer a non-diffusing, 2-equivalent color coupler which, under chromogenic development conditions, by coupling with a color developer oxidation product, releases a photographically inert ballast group from the coupling site and so forms a dye removable by rinsing which makes no contribution to color density. In a preferred embodiment of the invention, the non-diffusing, 2-equivalent color coupler which, under chromogenic development conditions, by coupling with a color developer oxidation product, releases a photographically inert ballast group from the coupling site and so forms a dye removable by rinsing which makes no contribution to color density, is a cyan coupler, for example a naphtholic or phenolic coupler, which is preferably located in the most highly sensitive sub-layer of a green-sensitive silver halide emulsion layer unit consisting of two or more sub-layers. The material exhibits an improved sensitivity/grain or gradation/grain relationship.

10 Claims, No Drawings

COLOR PHOTOGRAPHIC RECORDING MATERIAL CONTAINING A NON-DIFFUSING, 2-EQUIVALENT COUPLER WHICH, ON COUPLING, FORMS A DYE REMOVABLE BY RINSING

This invention relates to a multi-layer colour photographic recording material which contains in at least one photosensitive silver halide emulsion layer a non-diffusing, 2-equivalent colour coupler which, by coupling with a colour developer oxidation product, releases a photographically inert ballast group from the coupling site and so forms a dye removable by rinsing which makes no contribution to colour density.

It is known that greater sensitivity and colour density may be achieved with colour couplers having higher rate constants for the coupling reaction with colour developer oxidation products than with those having lower rate constants. This is, however, always associated with greater grain. Grain may, however, be improved by using colour couplers yielding dyes which are not completely non-diffusible in the photographic material, but this always also has a negative effect on the sharpness of the material; Known coupler structures are thus incapable of fulfilling all requirements for sensitivity, gradation, grain and sharpness.

Couplers which, on chromogenic development, yield a dye removable by rinsing which makes no contribution to colour density are known, for example from EP-A-0 443 530, EP-A-0 520 496, EP-A-0 520 498, EP-A-0 522 371, EP-A-0 523 423, EP-A-0 577 182, EP-A-0 577 183, U.S. Pat. No. 4,482,629. Dyes produced from such couplers are removable by rinsing because the coupler residue is provided with one or more groups having a solubilising action in the processing baths such that, once a ballast residue has been eliminated from the coupling site during processing, the resultant dye is rinsed out of the material. Such couplers are used because the eliminable ballast residue is provided with certain functions which may be exploited to improve the photographic properties of the recording materials. A development inhibitor, a development accelerator, a bleaching accelerator, a hardener, an image dye or image dye precursor or another photographically active group may, for example, be released on elimination or as a result of elimination of the ballast residue. U.S. Pat. No. 4,310,618 discloses, for example, couplers which, on chromogenic coupling with an oxidised colour developer, form a dye removable by rinsing and simultaneously release a residue capable of coupling as a fugitive group, which becomes capable of coupling only once it has been released. In this manner, 6- or 8-equivalent couplers may be obtained which improve grain. A feature common to all the stated couplers which couple to yield a dye removable by rinsing is, however, that the fugitive group thereof is photographically active.

DE-A-31 35 938 and EP-A-0 109 831 describe colour couplers which contain at the coupling site an eliminable ballast residue and, in a non-coupling position, a residue having a solubilising action or imparting diffusibility and which, on chromogenic coupling, form a diffusible dye. These colour couplers are used in conjunction with a mordant which binds the dye, so preventing it from being rinsed out of the material. The dyes formed are thus deliberately used for producing the image, for example in a dye transfer process or to improve grain, but this is always associated with impairment of image sharpness.

The object of the invention is to achieve higher sensitivity and colour density without impairing grain and image sharpness.

It has been found that the sensitivity/grain or gradation/grain relationship is improved by using non-diffusing, 2-equivalent colour couplers which, under chromogenic development conditions, by coupling with a colour developer oxidation product, release a photographically inert ballast group from the coupling site, and so form a dye removable by rinsing which makes no contribution to the colour density of the resultant colour image.

The present invention provides a colour photographic recording material containing at least one red-sensitive silver halide emulsion layer, which is associated with a cyan coupler, at least one green-sensitive silver halide emulsion layer, which is associated with a magenta coupler, at least one blue-sensitive silver halide emulsion layer, which is associated with a yellow coupler, and optionally further non-photosensitive layers, characterised in that at least one of the photosensitive silver halide emulsion layers contains a non-diffusing, 2-equivalent colour coupler which, under chromogenic development conditions, by coupling with a colour developer oxidation product, releases a photographically inert ballast group from the coupling site, and so forms a dye removable by rinsing which makes no contribution to the colour density of the resultant colour image (colour couplers according to the invention).

The colour photographic recording material according to the invention contains no substances capable of binding the diffusing dyes and retaining colour. In particular, the recording material according to the invention contains no mordants for diffusing dyes. Likewise, the exposed recording material is not processed under conditions which counteract the intended complete removal by rinsing of the soluble dye formed from the colour coupler according to the invention.

In a preferred embodiment of the invention, the recording material according to the invention contains in at least one photosensitive silver halide emulsion layer a non-diffusing, 2-equivalent cyan coupler which, under chromogenic development conditions, by coupling with a colour developer oxidation product, releases a photographically inert ballast group from the coupling site and so forms a cyan dye removable by rinsing which makes no contribution to colour density. Both naphtholic and phenolic couplers may be considered as the cyan coupler. A cyan coupler preferably used according to the invention is, for example, of the following structure:

LC-1

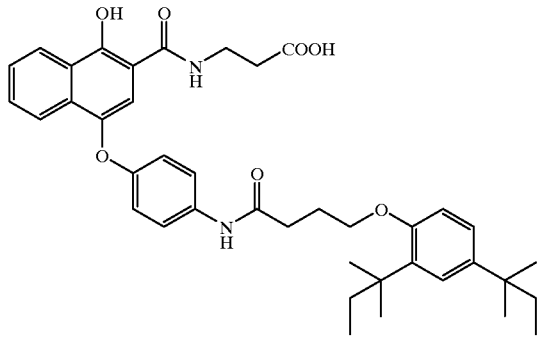

Preferably, therefore, the colour coupler according to the invention, in particular a cyan coupler according to the invention, i.e. a non-diffusing, 2-equivalent cyan coupler, which, under chromogenic development conditions, by coupling with a colour developer oxidation product, releases a photographically inert ballast group from the coupling site and so forms a cyan dye removable by rinsing which makes no contribution to colour density, is used in a green-sensitive silver halide emulsion layer, with a magenta coupler conventionally being associated with this layer as the image dye-producing colour coupler.

In the event that the colour photographic recording material according to the invention contains at least one photosensitive silver halide emulsion layer unit containing two or more silver halide emulsion sub-layers of the same spectral sensitivity but of different general sensitivity (speed), the colour coupler according to the invention is preferably located in the most highly sensitive sub-layer of such a multi-layer silver halide emulsion layer unit. In such a particularly preferred embodiment of the invention, a cyan coupler according to the invention is used in the most highly sensitive green-sensitive sub-layer which contains a magenta coupler as the image dye-producing colour coupler.

The quantity used of the colour coupler according to the invention is 5–200 mg/m$^2$, preferably 20–100 mg/m$^2$. A colour coupler according to the invention, in particular a cyan coupler according to the invention, is preferably used together with a DIR coupler.

Examples of colour photographic recording materials according to the invention are in particular colour negative films, but also colour reversal films, colour positive films, colour photographic paper, colour reversal photographic paper. A review of typical colour photographic materials together with preferred embodiments and processing methods are given in *Research Disclosure* 37038 February 1995).

The photographic materials consist of a support onto which at least one photosensitive silver halide emulsion layer is applied. Thin films and sheets are in particular suitable as supports. A review of support materials and the auxiliary layers applied to the front and reverse sides of which is given in *Research Disclosure* 37254, part 1 (1995), page 285.

The colour photographic materials conventionally contain at least one red-sensitive, one green-sensitive and one blue-sensitive silver halide emulsion layer, optionally together with interlayers and protective layers.

Depending upon the nature of the photographic material, these layers may be differently arranged. This is demonstrated for the most important products:

Colour photographic films such as colour negative films and colour reversal films have on the support, in the sequence stated below, 2 or 3 red-sensitive, cyan-coupling silver halide emulsion layers, 2 or 3 green-sensitive, magenta-coupling silver halide emulsion layers and 2 or 3 blue-sensitive, yellow-coupling silver halide emulsion layers. The layers of identical spectral sensitivity differ with regard to their photographic sensitivity, wherein the less sensitive sub-layers are generally arranged closer to the support than the more highly sensitive sub-layers.

A yellow filter layer is conventionally arranged between the green-sensitive and blue-sensitive layers to prevent blue light from reaching the underlying layers.

Possible options for different layer arrangements and the effects thereof on photographic properties are described in *J. Inf. Rec. Mats.,* 1994, volume 22, pages 183–193.

Colour photographic paper, which is usually substantially less photosensitive than a colour photographic film, conventionally has on the support, in the sequence stated below, one blue-sensitive, yellow-coupling silver halide emulsion layer, one green-sensitive, magenta-coupling silver halide emulsion layer and one red-sensitive, cyan-coupling silver halide emulsion layer; the yellow filter layer may be omitted.

The number and arrangement of the photosensitive layers may be varied in order to achieve specific results. For example, all high sensitivity layers may be grouped together in one package of layers in a photographic film and all low sensitivity layers may be grouped together in another package of layers in order to increase sensitivity (DE-A-25 30 645).

The substantial constituents of the photographic emulsion layers are binders, silver halide grains and colour couplers.

Details of suitable binders may be found in *Research Disclosure* 37254, part 2 (1995), page 286.

Details of suitable silver halide emulsions, the production, ripening, stabilisation and spectral sensitisation thereof, including suitable spectral sensitisers, may be found in *Research Disclosure* 36544 (September 1994) and *Research Disclosure* 37254, part 3 (1995), page 286 and in *Research Disclosure* 37038, part XV (1995), page 89.

Photographic materials having camera sensitivity conventionally contain silver bromide-iodide emulsions, which may optionally also contain small proportions of silver chloride. Photographic print materials contain either silver chloride-bromide emulsions containing up to 80 mol. % of AgBr or silver chloride-bromide emulsions containing above 95 mol. % of AgCl.

Details relating to colour couplers may be found in *Research Disclosure* 37254, part 4 (1995), page 288 and in *Research Disclosure* 37038, part II (1995), page 80. The maximum absorption of the dyes formed from the couplers and the developer oxidation product is preferably within the following ranges: yellow coupler 430 to 460 nm, magenta coupler 540 to 560 nm, cyan coupler 630 to 700 nm.

In order to improve sensitivity, grain, sharpness and colour separation in colour photographic films, compounds are frequently used which, on reaction with the developer oxidation product, release photographically active compounds, for example DIR couplers which eliminate a development inhibitor.

Details relating to such compounds, in particular couplers, may be found in *Research Disclosure* 37254, part 5 (1995), page 290 and in *Research Disclosure* 37038, part XIV (1995), page 86.

Colour couplers, which are usually hydrophobic, as well as other hydrophobic constituents of the layers, are conventionally dissolved or dispersed in high-boiling organic solvents. These solutions or dispersions are then emulsified into an aqueous binder solution (conventionally a gelatine solution) and, once the layers have dried, are present as fine droplets (0.05 to 0.8 nm in diameter) in the layers.

Suitable high-boiling organic solvents, methods for the introduction thereof into the layers of a photographic material and further methods for introducing chemical compounds into photographic layers may be found in *Research Disclosure* 37254, part 6 (1995), page 292.

The non-photosensitive interlayers generally located between layers of different spectral sensitivity may contain agents which prevent an undesirable diffusion of developer oxidation products from one photosensitive layer into another photosensitive layer with a different spectral sensitisation.

Suitable compounds (white couplers, scavengers or DOP scavengers) may be found in *Research Disclosure* 37254, part 7 (1995), page 292 and in *Research Disclosure* 37038, part III (1995), page 84.

The photographic material may also contain UV light absorbing compounds, optical brighteners, spacers, filter dyes, formalin scavengers, light stabilisers, anti-oxidants, $D_{min}$ dyes, additives to improve stabilisation of dyes, couplers and whites and to reduce colour fogging, plasticisers (latices), biocides and others.

Suitable compounds may be found in *Research Disclosure* 37254, part 8 (1995), page 292 and in *Research Disclosure* 37038, parts IV, V, VI, VII, X, XI and XIII (1995), pages 84 et seq. The layers of colour photographic materials are conventionally hardened, i.e. the binder used, preferably gelatine, is crosslinked by appropriate chemical methods.

Suitable hardener substances may be found in *Research Disclosure* 37254, part 9 (1995), page 294 and in *Research Disclosure* 37038, part XII (1995), page 86.

Once exposed with an image, colour photographic materials are processed using different processes depending upon their nature. Details relating to processing methods and the necessary chemicals are disclosed in *Research Disclosure* 37254, part 10 (1995), page 294 and in *Research Disclosure* 37038, parts XVI to XXIII (1995), pages 95 et seq. together with example materials.

EXAMPLE 1

A colour photographic recording material for colour negative development was produced (layer structure 1A, comparison) by applying the following layers in the stated sequence onto a transparent cellulose triacetate film support. Quantities are stated per 1 $m^2$. The silver halide application rate is stated as the corresponding quantities of $AgNO_3$. All the silver halide emulsions were stabilised with 0.1 g of 4-hydroxy-6-methyl-1,3,3a,7-tetraazaindene per 100 g of $AgNO_3$.

Layer structure 1A

Layer 1: (Anti-halation layer)

Black colloidal silver sol with

| | |
|---|---|
| 0.3 | g of Ag |
| 1.2 | g of gelatine |
| 0.4 | g of UV absorber XUV-1 |
| 0.02 | g of tricresyl phosphate (TCP) |

Layer 2: (Micrate interlayer)

Micrate silver bromide-iodide emulsion (0.5 mol. % iodide; average grain diameter 0.07 mm) prepared from 0.25 g of $AgNO_3$ with

| | |
|---|---|
| 1.0 | g of gelatine |

Layer 3: ($1^{st}$ red-sensitised layer, low sensitivity)

Red-sensitive silver bromide-iodide emulsion (4 mol. % iodide; average grain diameter 0.5 mm) prepared from 2.7 g of $AgNO_3$ with

| | |
|---|---|
| 2.0 | g of gelatine |
| 0.88 | g of cyan coupler XC-1 |
| 0.05 | g of coloured coupler XCR-1 |
| 0.07 | g of coloured coupler XCY-1 |
| 0.02 | g of DIR coupler XDIR-1 |
| 0.75 | g of TCP |

Layer 4: ($2^{nd}$ red-sensitised layer, high sensitivity)

Red-sensitised silver bromide-iodide emulsion (12 mol. % iodide; average grain diameter 1.0 mm) prepared from 2.2 g of $AgNO_3$ with

| | |
|---|---|
| 1.8 | g of gelatine |
| 0.19 | g of cyan coupler XC-2 |
| 0.17 | g of TCP |

Layer 5: (Interlayer)

| | |
|---|---|
| 0.4 | g of gelatine |
| 0.15 | g of white coupler XW-1 |
| 0.06 | g of aurintricarboxylic acid aluminium salt |

Layer 6: ($1^{st}$ green-sensitised layer, low sensitivity)

Green-sensitised silver bromide-iodide emulsion (4 mol. % iodide; average grain diameter 0.35 mm) prepared from 1.9 g of $AgNO_3$ with

| | |
|---|---|
| 1.8 | g of gelatine |
| 0.54 | g of magenta coupler XM-1 |
| 0.065 | g of coloured coupler XMY-1 |
| 0.24 | g of DIR coupler XDIR-1 |
| 0.6 | g of TCP |

Layer 7: ($2^{nd}$ green-sensitive layer, high sensitivity)

Green-sensitised silver bromide-iodide emulsion (9 mol. % iodide; average grain diameter 0.8 mm) prepared from 1.25 g of $AgNO_3$ with

| | |
|---|---|
| 1.1 | g of gelatine |
| 0.195 | g of magenta coupler XM-2 |
| 0.05 | g of coloured coupler XMY-2 |
| 0.245 | g of TCP |

Layer 8: (Yellow filter layer)

Yellow colloidal silver sol with

| | |
|---|---|
| 0.09 | g of Ag |
| 0.25 | g of gelatine |
| 0.08 | g of scavenger XSC-1 |
| 0.40 | g of formaldehyde scavenger XFF-1 |
| 0.08 | g of TCP |

Layer 9: ($1^{st}$ blue-sensitive layer, low sensitivity)

Blue-sensitised silver bromide-iodide emulsion (6 mol. % iodide; average grain diameter 0.6 mm) prepared from 0.9 g of $AgNO_3$ with

| | |
|---|---|
| 2.2 | g of gelatine |
| 1.1 | g of yellow coupler XY-1 |
| 0.037 | g of DIR coupler XDIR-1 |
| 1.14 | g of TCP |

Layer 10: ($2^{nd}$ blue-sensitive layer, high sensitivity)

Blue-sensitised silver bromide-iodide emulsion (10 mol. % iodide; average grain diameter 1.2 mm) prepared from 0.6 g of $AgNO_3$ with

| | |
|---|---|
| 0.6 | g of gelatine |
| 0.2 | g of yellow coupler XY-1 |
| 0.003 | g of DIR coupler XDIR-1 |
| 0.22 | g of TCP |

Layer 11: (Micrate layer)

Micrate silver bromide-iodide emulsion (0.5 mol. % iodide; average grain diameter 0.06 mm) prepared from 0.06 g of $AgNO_3$ with

| | |
|---|---|
| 1.0 | g of gelatine |
| 0.3 | g of UV absorber XUV-2 |
| 0.3 | g of TCP |

Layer 12: (Protective & hardening layer)

| | |
|---|---|
| 0.25 | g of gelatine |
| 0.75 | g of hardener XH-1, such that, once hardened, the complete layer structure had a swelling factor of ≦ 3.5. |

Compounds used in layer structure 1A:

XUV-1

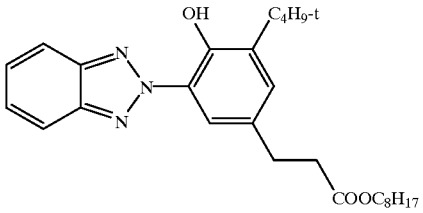

XUV-2

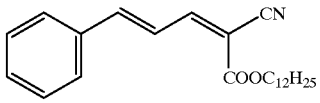

XW-1

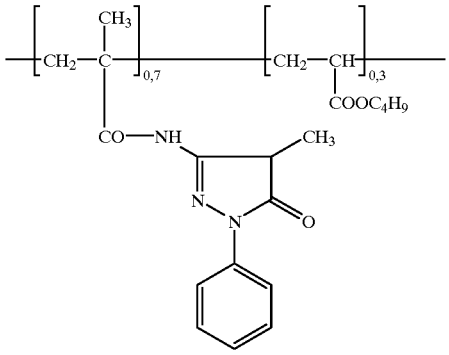

XC-1

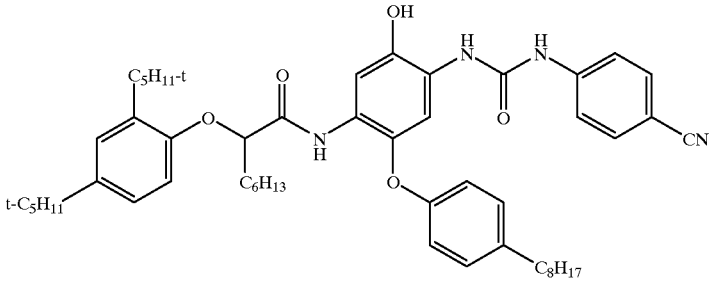

XC-2

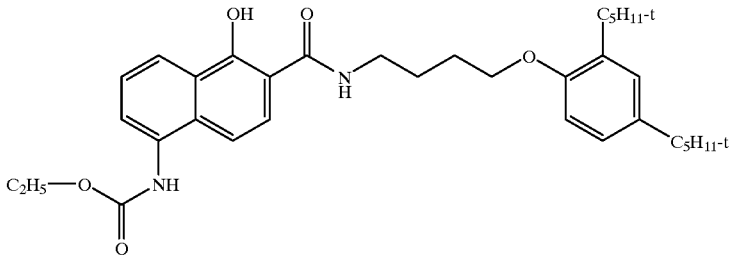

-continued
XCR-1
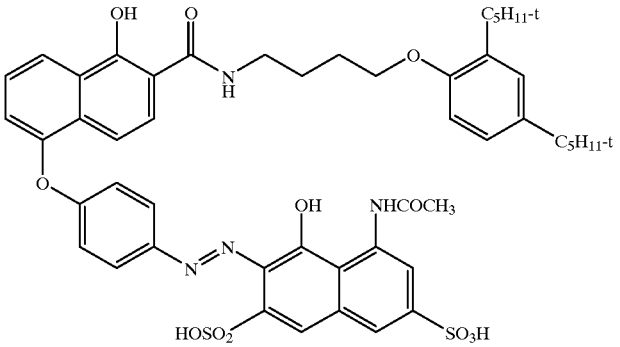
XCY-1
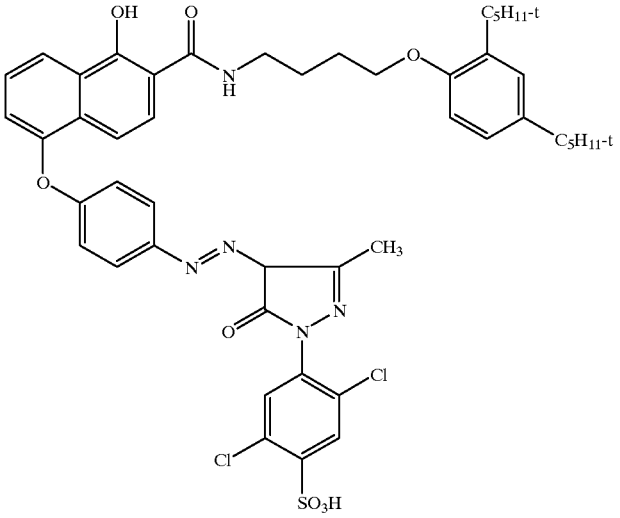
XM-1
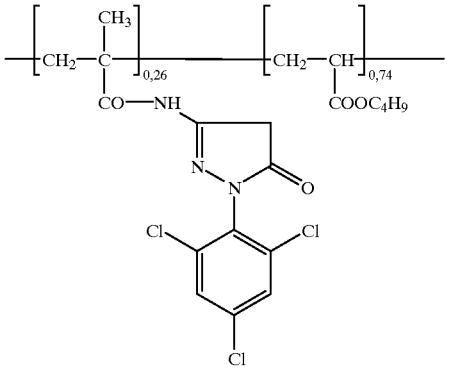
XM-2
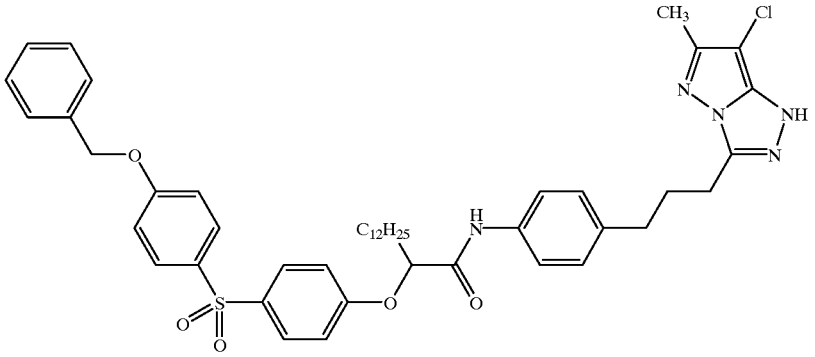

-continued
XMY-1
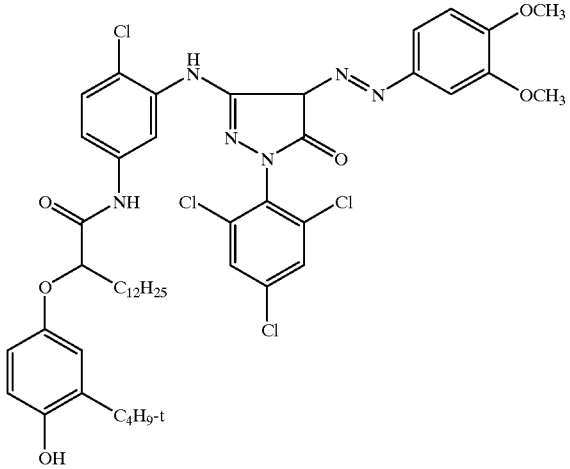
XMY-2
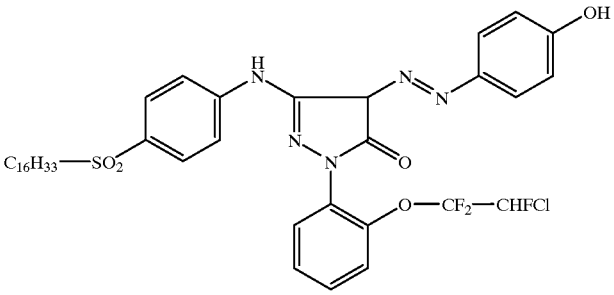
XY-1
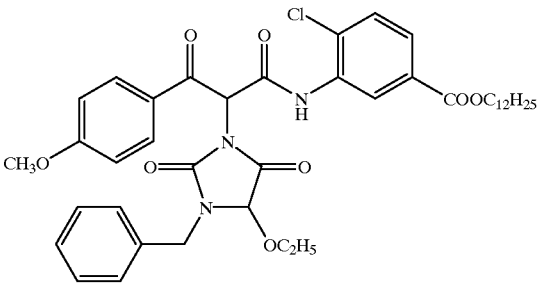
XDIR-1
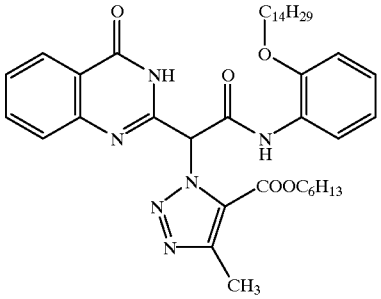
XSC-1
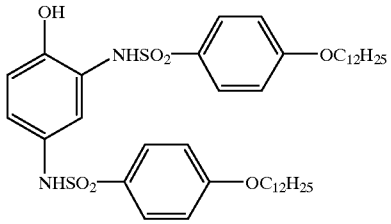
XH-1
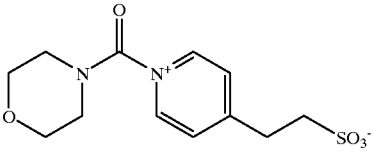

-continued

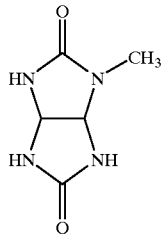

After exposure with a grey wedge, development was performed in accordance with *The British Journal of Photography,* 1974, pp.597–598.

Layer structures 1B–1D differ from layer structure 1A in the composition of layer 7:

Layer structure 1B

Layer 7: ($2^{nd}$ green-sensitive layer, high sensitivity)

Green-sensitised silver bromide-iodide emulsion (9 mol. % iodide; average gram diameter 0.8 mm) prepared from 1.25 g of $AgNO_3$ with

| | |
|---|---|
| 1.2 | g of gelatine |
| 0.195 | g of magenta coupler XM-2 |
| 0.05 | g of coloured coupler XMY-2 |
| 0.05 | g of soluble cyan coupler LC-1 |
| 0.295 | g of TCP |

LC-1

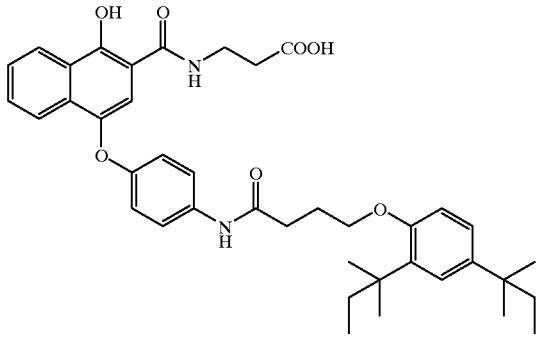

Layer structure 1C

Layer 7: ($2^{nd}$ green-sensitive layer, high sensitivity)

Green-sensitised silver bromide-iodide emulsion (9 mol. % iodide; average grain diameter 0.8 mm) prepared from 1.25 g of $AgNO_3$ with

| | |
|---|---|
| 1.2 | g of gelatine |
| 0.195 | g of magenta coupler XM-2 |
| 0.05 | g of coloured coupler XMY-2 |
| 0.04 | g of soluble cyan coupler LC-2 |
| 0.29 | g of TCP |

XFF-1

LC-2

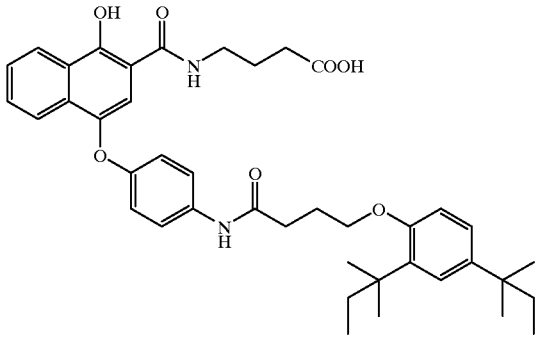

Layer structure 1D

Layer 7: ($2^{nd}$ green-sensitive layer, high sensitivity)

Green-sensitised silver bromide-iodide emulsion (9 mol. % iodide; average grain diameter 0.8 mm) prepared from 1.25 g of $AgNO_3$ with

| | |
|---|---|
| 1.2 | g of gelatine |
| 0.195 | g of magenta coupler XM-2 |
| 0.05 | g of coloured coupler XMY-2 |
| 0.01 | g of DIR coupler XDIR-2 |
| 0.07 | g of soluble cyan coupler LC-1 |
| 0.33 | g of TCP |

XDIR-2

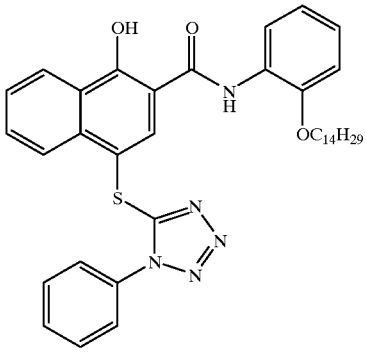

Layer structure 1E matches layer structure 1C in the composition of layer 7 and differs from layer structure 1C only in the composition of layer 6:

Layer structure 1E

Layer 6: ($1^{st}$ green-sensitive layer, low sensitivity)

Green-sensitised silver bromide-iodide emulsion (4 mol. % iodide; average grain diameter 0.35 μm) prepared from 1.9 g of $AgNO_3$ with

| | |
|---|---|
| 1.9 | g of gelatine |
| 0.54 | g of magenta coupler XM-1 |
| 0.065 | g of coloured coupler XMY-1 |
| 0.24 | g of DIR coupler XDIR-1 |
| 0.06 | g of soluble cyan coupler LC-2 |
| 0.7 | g of TCP |

Layer structure 1F matches layer structure 1A in the composition of layer 7 and differs from layer structure 1A only in the composition of layer 8:

Layer structure 1F

Layer 8: (Yellow filter layer)

Yellow colloidal silver sol with

| | |
|---|---|
| 0.09 | g of Ag |
| 0.32 | g of gelatine |
| 0.08 | g of scavenger XSC-1 |
| 0.07 | g of soluble cyan coupler LC-1 |
| 0.40 | g of formaldehyde scavenger XFF-1 |
| 0.15 | g of TCP |

Photographic results are shown in Table 1.

TABLE 1

| Layer structure | Relative green sensitivity | Magenta gradation | Magenta grain*) | |
|---|---|---|---|---|
| 1A | 100 | 65 | 12 | Comparison |
| 1B | 102 | 71 | 12 | Invention |
| 1C | 105 | 74 | 13 | Invention |
| 1D | 100 | 67 | 11 | Invention |
| 1E | 106 | 77 | 13 | Invention |
| 1F | 100 | 65 | 12 | Comparison |

*)Grain (RMS) at density 0.6 above fog, values × 1000.

As is evident, there is an improvement in the sensitivity/grain or gradation/grain relationship in the materials according to the invention.

EXAMPLE 2

Layer structures 2A–2C differ from layer structure 1A from Example 1 only in the composition of layer 8:

Layer 8: (Yellow filter layer)

| | |
|---|---|
| 0.25 | g of gelatine |
| 0.05 | g of yellow filter dye XGF-1 |
| 0.08 | g of scavenger XSC-1 |
| 0.40 | g of formaldehyde scavenger XFF-1 |
| 0.08 | g of TCP |

XGF-1

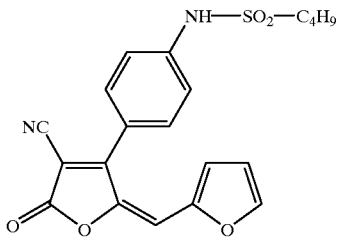

Layer structures 2B and 2C differ from layer structure 2A only in the composition of layer 10:

Layer structure 2B

Layer 10: ($2^{nd}$ blue-sensitive layer, high sensitivity)

Blue-sensitised silver bromide-iodide emulsion (10 mol. % iodide; average grain diameter 1.2 μm) prepared from 0.6 g of $AgNO_3$ with

| | |
|---|---|
| 0.7 | g of gelatine |
| 0.2 | g of yellow coupler XY-1 |
| 0.003 | g of DIR coupler XDIR-1 |
| 0.07 | g of soluble cyan coupler XLC-3 |
| 0.3 | g of TCP |

XLC-3

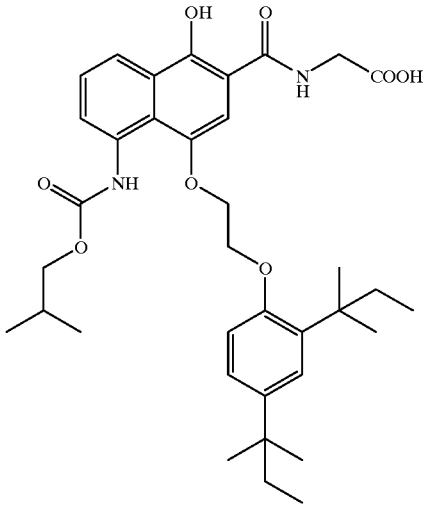

Layer structure 2C

Layer 10: ($2^{nd}$ blue-sensitive layer, high sensitivity)

Blue-sensitised silver bromide-iodide emulsion (10 mol. % iodide; average grain diameter 1.2 μm) prepared from 0.6 g of $AgNO_3$ with

| | |
|---|---|
| 0.7 | g of gelatine |
| 0.2 | g of yellow coupler XY-1 |
| 0.007 | g of DIR coupler XDIR-1 |
| 0.07 | g of soluble cyan coupler XLC-4 |
| 0.3 | g of TCP |

XLC-4

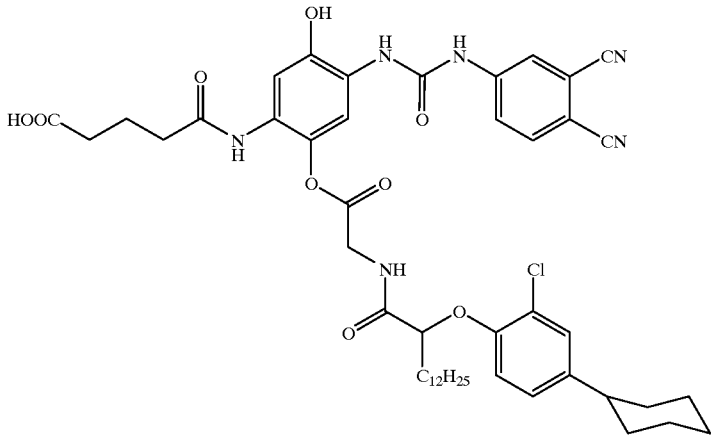

Photographic results are shown in Table 2.

TABLE 2

| Layer structure | Relative blue sensitivity | Yellow gradation | Yellow grain*) | |
|---|---|---|---|---|
| 2A | 100 | 70 | 18 | Comparison |
| 2B | 106 | 78 | 19 | Invention |
| 2C | 102 | 73 | 17 | Invention |

*)Grain (RMS) at density 0.6 above fog, values × 1000.

As is evident, there is an improvement in the sensitivity/grain or gradation/grain relationship in the materials according to the invention.

What is claimed is:

1. A color photographic recording material which comprises at least one red-sensitive silver halide emulsion layer, which is associated with a cyan coupler, at least one green-sensitive silver halide emulsion layer, which is associated with a magenta coupler, at least one blue-sensitive silver halide emulsion layer, which is associated with a yellow coupler, and optionally further non-photosensitive layers, and at least one of the green sensitive silver halide emulsion layers contains a non-diffusing, 2-equivalent color coupler which, under chromogenic development conditions, by coupling with a color developer oxidation product, releases a photographically inert ballast group from the coupling site, and so forms a dye removable by rinsing which makes no contribution to color density and said one of the green-sensitive silver halide emulsion layers contains in addition a DIR coupler.

2. The recording material according to claim 1, wherein in at least one photosensitive silver halide emulsion layer a non-diffusing, 2-equivalent cyan coupler which, under chromogenic development conditions, by coupling with a color developer oxidation product, releases a photographically inert ballast group from the coupling site and so forms a cyan dye removable by rinsing which makes no contribution to color density.

3. The recording material according to claim 2, wherein the non-diffusing, 2-equivalent cyan coupler is a naphtholic or phenolic coupler.

4. The recording material according to claim 1, wherein the non-diffusing, 2-equivalent color coupler is located in the most highly sensitive sub-layer of a silver halide emulsion layer unit consisting of two or more sub-layers of the same spectral sensitivity.

5. The recording material according to claim 4, wherein the non-diffusing 2-equivalent color coupler is a non-diffusing 2-equivalent cyan coupler and is located in the most highly sensitive sub-layer of a green-sensitive silver halide emulsion layer unit consisting of two or more sub-layers.

6. A color photographic recording material which comprises at least one red-sensitive silver halide emulsion layer, which is associated with a cyan coupler, at least one green-sensitive silver halide emulsion layer, which is associated with a magenta coupler, at least one blue-sensitive silver halide emulsion layer, which is associated with a yellow coupler, and optionally further non-photosensitive layers, and at least one of the photosensitive silver halide emulsion layers contains a DIR coupler and a non-diffusing, 2-equivalent color coupler which, under chromogenic development conditions, by coupling with a color developer oxidation product, releases a photographically inert ballast group from the coupling site, and so forms a dye removable by rinsing which makes no contribution to color density.

7. The recording material according to claim 6, wherein in at least one photosensitive silver halide emulsion layer a non-diffusing, 2-equivalent cyan coupler which, under chromogenic development conditions, by coupling with a color developer oxidation product, releases a photographically inert ballast group from the coupling site and so forms a cyan dye removable by rinsing which makes no contribution to color density.

8. The recording material according to claim 7, wherein the non-diffusing, 2-equivalent cyan coupler is a naphtholic or phenolic coupler.

9. The recording material according to claim 6, wherein the non-diffusing, 2-equivalent color coupler is located in the most highly sensitive sub-layer of a silver halide emulsion layer unit consisting of two or more sub-layers of the same spectral sensitivity.

10. The recording material according to claim 9, wherein the non-diffusing 2-equivalent color coupler is a non-diffusing 2-equivalent cyan coupler and is located in the most highly sensitive sub-layer of a green-sensitive silver halide emulsion layer unit consisting of two or more sub-layers.

* * * * *